US010272693B2

(12) United States Patent
Ueda et al.

(10) Patent No.: US 10,272,693 B2
(45) Date of Patent: Apr. 30, 2019

(54) AIR TRAP UNIT, INK SUPPLY SYSTEM, AND INKJET PRINTER

(71) Applicant: Roland DG Corporation, Hamamatsu-shi, Shizuoka (JP)

(72) Inventors: Naoki Ueda, Hamamatsu (JP); Yoshitaka Hatano, Hamamatsu (JP); Kenji Seki, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/831,463

(22) Filed: Dec. 5, 2017

(65) Prior Publication Data

US 2018/0154651 A1 Jun. 7, 2018

(30) Foreign Application Priority Data

Dec. 6, 2016 (JP) ..... 2016-236887

(51) Int. Cl.

| | |
|---|---|
| ***B41J 2/185*** | (2006.01) |
| ***B41J 2/18*** | (2006.01) |
| ***B41J 2/19*** | (2006.01) |
| ***B41J 2/175*** | (2006.01) |
| ***B41J 29/38*** | (2006.01) |

(52) U.S. Cl.

CPC ..... *B41J 2/185* (2013.01); *B41J 2/17509* (2013.01); *B41J 2/18* (2013.01); *B41J 2/19* (2013.01); *B41J 29/38* (2013.01); *B41J 2/17596* (2013.01); *B41J 2202/07* (2013.01)

(58) Field of Classification Search

CPC . B41J 2/185; B41J 2/18; B41J 2/17509; B41J 29/38; B41J 2/19; B41J 2202/07; B41J 2/17596

See application file for complete search history.

(56) References Cited

U.S. PATENT DOCUMENTS

2011/0080456 A1* 4/2011 Shibata ..... B41J 2/14233 347/92

FOREIGN PATENT DOCUMENTS

JP 59-209152 * 11/1984 ..... B41J 3/04
JP 2006-205415 A 8/2006

OTHER PUBLICATIONS

Ueda et al., "Ink Supply System and Inkjet Printer,", U.S. Appl. No. 15/831,461, filed Dec. 5, 2017.

* cited by examiner

*Primary Examiner* — Geoffrey S Mruk
(74) *Attorney, Agent, or Firm* — Keating & Bennett, LLP

(57) ABSTRACT

An air trap unit includes an air trap container that stores ink, a flow inlet provided in the air trap container and allowing the ink to flow into the air trap container, a flow outlet provided in the air trap container and allowing the ink in the air trap container to flow out, and an inclination mechanism that inclines the air trap container such that the air trap container is put into one of a first state and a second state, the first state being a state where the air trap container is inclined such that the flow inlet is at a level higher than, or equal to, that of the flow outlet, and the second state being a state where the air trap container is inclined such that the flow outlet is at a level higher than that of the flow inlet.

13 Claims, 10 Drawing Sheets

AIR TRAP UNIT, INK SUPPLY SYSTEM, AND INKJET PRINTER

CROSS REFERENCE TO RELATED APPLICATION

This application claims the benefit of priority to Japanese Patent Application No. 2016-236887 filed on Dec. 6, 2016. The entire contents of this application are hereby incorporated herein by reference.

BACKGROUND OF THE INVENTION

1. Field of the Invention

The present invention relates to an air trap unit, an ink supply system including the air trap unit, and an inkjet printer including the ink supply system.

2. Description of the Related Art

Conventionally, an inkjet printer including an ink head that ejects ink and an ink tank storing ink to be supplied to the ink head is known. In this type of inkjet printer, the ink tank and the ink head are in communication with each other via an ink flow channel such as a tube or the like. The ink in the ink tank is ejected from the ink head via the ink flow channel.

The ink in the ink flow channel may contain air bubbles (or air). In order to solve this, for example, Japanese Laid-Open Patent Publication No. 2006-205415 discloses an air trap provided in the ink flow channel to collect air contained in the ink. The air trap includes an air trap chamber temporarily storing the ink. In the air trap chamber, the air contained in the ink is separated from the ink. The air separated from the ink is stored in a top portion of the air trap chamber by buoyancy.

However, the air trap disclosed in Japanese Laid-Open Patent Publication No. 2006-205415 involves the possibility that the air trap chamber may overflow with the air in the top portion. If the air trap chamber overflows with the air in the top portion, the air in the air trap chamber may undesirably flow toward the ink head.

SUMMARY OF THE INVENTION

Preferred embodiments of the present invention provide air trap units, ink supply systems, and inkjet printers that store ink that contains air, and significantly reduce or prevent air-containing ink from flowing into an ink head.

An air trap unit according to a preferred embodiment of the present invention includes an air trap container, a flow inlet, a flow outlet, and an inclination mechanism. The air trap container stores ink. The flow inlet is provided in the air trap container and allows the ink to flow into the air trap container. The flow outlet is provided in the air trap container and allows the ink in the air trap container to flow out. Assuming a first state is a state where the air trap container is inclined such that the flow inlet is at a level higher than, or equal to, that of the flow outlet, and a second state is a state where the air trap container is inclined such that the flow outlet is at a level higher than that of the flow inlet, the inclination mechanism inclines the air trap container such that the air trap container is put into one of the first state and the second state.

According to the above-described air trap unit, when the air trap container is put into the first state by the inclination mechanism, the air trap container is inclined such that the flow inlet is at a level higher than, or equal to, that of the flow outlet. Therefore, the air contained in the ink flowing into the air trap container through the flow inlet is collected in the vicinity of the flow inlet. Thus, in the first state, the air-containing ink does not easily flow outside through the flow outlet. In contrast, when the air trap container is put into the second state by the inclination mechanism, the air trap container is inclined such that the flow outlet is at a level higher than that of the flow inlet. Therefore, the air contained in the ink in the air trap container is collected in the vicinity of the flow outlet. Thus, in the second state, the air easily flows outside through the flow outlet. For this reason, the ink in the air trap container that is supplied to the ink head in the first state contains no air. In the second state, the ink in the air trap container is not supplied to the ink head but is instead discharged outside.

Preferred embodiments of the present invention provide air trap units capable of storing ink that contains air, and significantly reducing or preventing the air-containing ink from flowing into an ink head.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of air trap units, ink supply systems each including an air trap unit, and inkjet printers each including an ink supply system according to one of the preferred embodiments of the present invention will be described with reference to the drawings. The preferred embodiments described below are not intended to specifically limit the present invention. Components and portions that have the same functions will bear the same reference signs, and overlapping descriptions will be omitted or simplified optionally.

Figure 1:
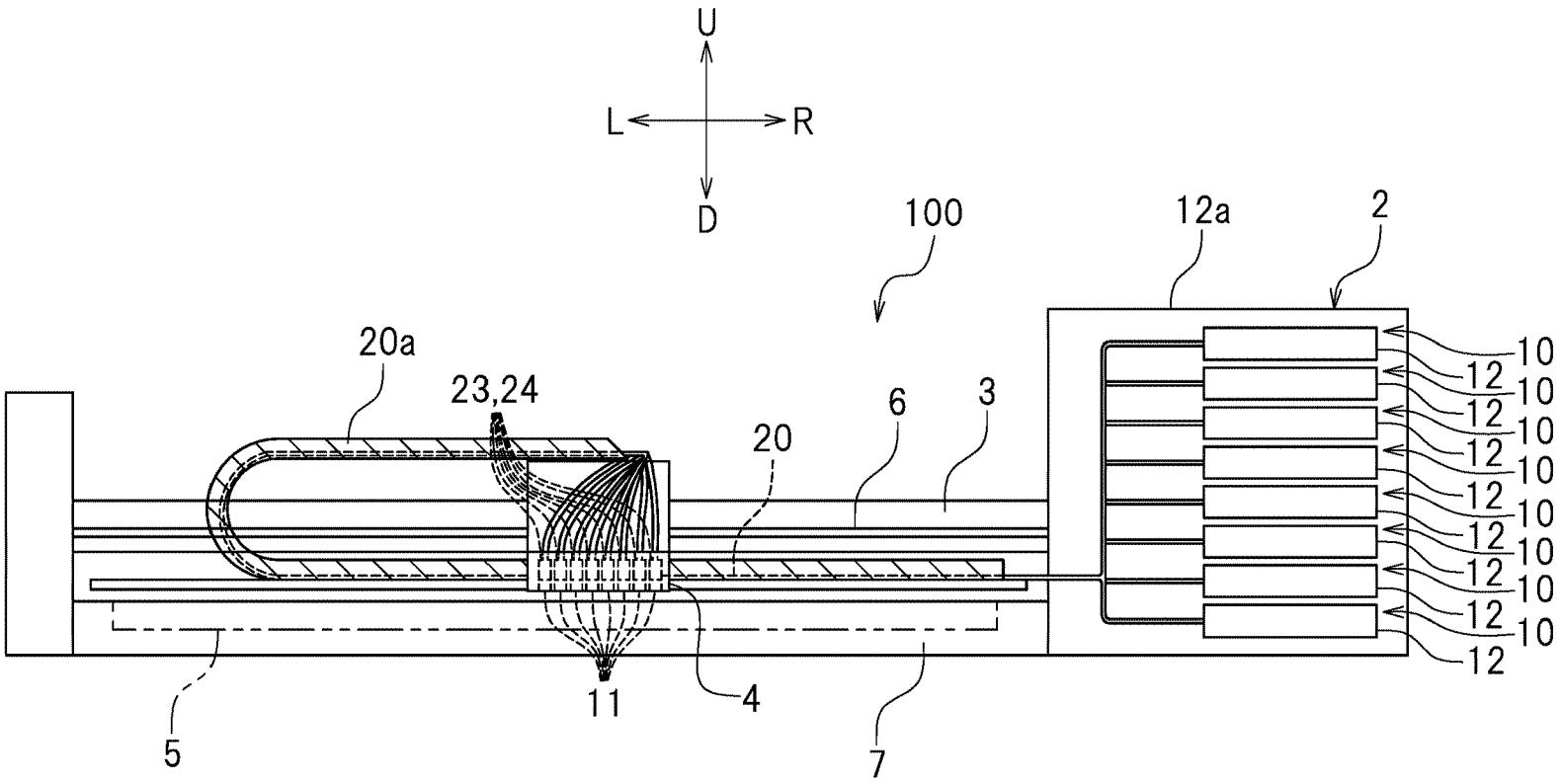
FIG. 1 is a front view showing a printer according to a preferred embodiment of the present invention.

FIG. 1 is a front view of an inkjet printer (hereinafter, referred to as a "printer") 100 according to a preferred embodiment of the present invention. The printer 100 preferably is included in an inkjet system. In this preferred embodiment, the term "inkjet system" refers to an inkjet system using, for example, any of various continuous methods including a binary deflection method, a continuous deflection method and the like, or any of various on-demand methods including a thermal method, a piezoelectric element method and the like. In the following description, letters F, Rr, L, R, U and D respectively represent "front", "rear", "left", "right", "up" and "down" as seen in a front view of the printer 100. These directions are provided merely for the sake of convenience, and do not limit the manner of installation or the like of the printer 100.

As shown in FIG. 1, the printer 100 performs printing on a recording medium 5. In this preferred embodiment, the recording medium 5 is a rolled recording paper sheet, namely, a so-called rolled paper sheet. The recording medium 5 is not limited to being such a rolled recording paper sheet. For example, the recording medium 5 may be a resin sheet. The recording medium 5 is not limited to being a flexible sheet. For example, the recording medium 5 may be a hard medium such as a glass substrate or the like. In this preferred embodiment, there is no specific limitation on the material of the recording medium 5.

In this preferred embodiment, the printer 100 includes a printer main body 2 and a guide rail 3 secured to the printer main body 2. For example, the guide rail 3 extends in a left-right direction. In this example, the guide rail 3 is engaged with a carriage 4. The carriage 4 is slidable along the guide rail 3. Although not shown, a roller is provided at each of a left end and a right end of the guide rail 3. Either one of the rollers is connected with a carriage motor (not shown). The roller connected with the carriage motor is rotatable by the carriage motor. In this example, an endless belt 6 is wound along the rollers respectively provided at both of the two ends of the guide rail 3. The carriage 4 is secured to the belt 6. The carriage motor is driven to rotate the roller, and thus the belt 6 runs. When the belt 6 runs, the carriage 4 is moved in the left-right direction. As can be seen, the carriage 4 is movable in the left-right direction along the guide rail 3.

In this preferred embodiment, the printer main body 2 includes a platen 7, on which the recording medium 5 is to be placed. The platen 7 supports the recording medium 5 when printing is provided on the recording medium 5. The platen 7 includes a grit roller and a pinch roller (neither is shown) as a pair of, namely, top and bottom, rollers. The grit roller is coupled with a feed motor (not shown). The grit roller is driven to rotate by the feed motor. The grit roller rotates in the state where the recording medium 5 is held between the grit roller and the pinch roller, so that the recording medium 5 is transported in a front-rear direction.

In this preferred embodiment, the printer 100 includes a plurality of ink supply systems 10. The ink supply systems 10 each supply ink from an ink tank 12 toward an ink head 11. The ink supply systems 10 also each circulate the ink supplied to the ink head 11. One ink supply system 10 is provided for each ink head 11. In other words, one ink supply system 10 is provided for each ink tank 12. In this preferred embodiment, preferably there are eight ink heads 11, and thus there are eight ink supply systems 10, for example. There is no specific limitation on the number of the ink heads 11, the number of the ink tanks 12, or the number of the ink supply systems 10. The plurality of ink supply systems 10 preferably have the same or substantially the same structure. Thus, one ink supply system 10 will be described in detail below.

Figure 2:
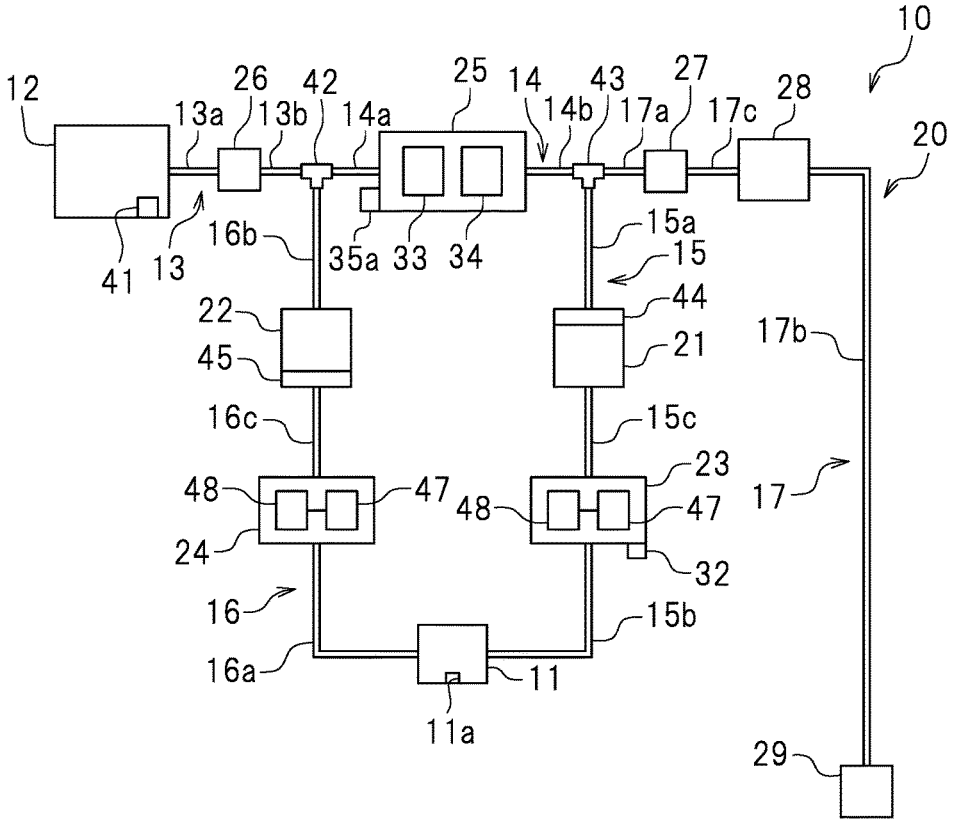
FIG. 2 is a schematic view showing an ink supply system.

FIG. 2 is a schematic view showing the ink supply system 10. As shown in FIG. 2, the ink supply system 10 includes the ink head 11, the ink tank 12, an ink flow channel 20, an upstream pump 21, a downstream pump 22, an upstream damper 23, a downstream damper 24, an air trap unit 25, an inlet valve 26, an outlet valve 27, and an outlet pump 28. In the following description, the side on which ink flows into the ink head 11 will be referred to as the "upstream side", and the side on which the ink flows out from the ink head 11 will be referred to as the "downstream side".

As shown in FIG. 1, the ink head 11 ejects ink toward the recording medium 5 placed on the platen 7. As shown in FIG. 2, a nozzle 11*a*, from which the ink is ejected, is provided in a bottom surface of the ink head 11. As shown in FIG. 1, the ink head 11 is mounted on the carriage 4. The ink head 11 is movable in the left-right direction via the carriage 4 along the guide rail 3. In more detail, the carriage motor running the belt 6 is driven, so that the ink head 11 is moved in the left-right direction along the carriage 4.

The ink tank 12 stores ink. In this preferred embodiment, the number of the ink tanks 12 preferably is equal to the number of the ink heads 11, for example. In this example, there are preferably eight ink tanks 12. One ink tank 12 is connected with one ink head 11. The ink stored in the ink tank 12 is supplied to the ink head 11. One ink tank 12 stores any one of, for example, process color ink such as cyan ink, magenta ink, yellow ink, light cyan ink, light magenta ink, black ink or the like, and spot color ink such as white ink, metallic ink, clear ink or the like. In this preferred embodiment, each two of the eight ink tanks 12 preferably store the same color of ink. For example, the eight ink supply systems 10 are grouped into four groups, namely, a first group, a second group, a third group and a fourth group. Two ink supply systems 10 belong to each group. For example, cyan ink is stored in the ink tanks 12 of the ink supply systems 10 in the first group. Magenta ink is stored in the ink tanks 12 of the ink supply systems 10 in the second group. Yellow ink is stored in the ink tanks 12 of the ink supply systems 10 in the third group. Black ink is stored in the ink tanks 12 of the ink supply systems 10 in the fourth group. It should be noted that the plurality of ink tanks 12 may store different colors of ink. Although not shown, each ink tank 12 includes an ink removal opening (not shown).

There is no specific limitation on the position of each ink tank 12. In this preferred embodiment, the ink tank 12 is detachably provided on the printer main body 12. In more detail, as shown in, for example, FIG. 1, the printer main body 12 includes an accommodation portion 12*a*. The plurality of ink tanks 12 are accommodated in the accommodation portion 12*a*. It should be noted that there is no specific limitation on the position of the ink tanks 12. For example, the ink tanks 12 may be detachably provided on the carriage 4.

As shown in FIG. 2, the ink tank 12 may include a detection sensor 41 that detects the amount of ink stored in the ink tank 12. There is no specific limitation on the type of the detection sensor 41. For example, the detection sensor 41 may include a photointerrupter. For example, the detection sensor 41 detects that the amount of the ink stored in the ink tank 12 is a predetermined amount.

The ink flow channel 20 is usable to supply the ink stored in the ink tank 12 to the ink head 11 and also to circulate the ink in the ink head 11. As shown in FIG. 1, in this preferred embodiment, at least a portion of the ink flow channel 20 is covered with a cable protection and guide device 20*a*. The cable protection and guide device 20*a* is, for example, a cableveyor (registered trademark). As shown in FIG. 2, the ink flow channel 20 includes an inlet flow channel 13, a connection flow channel 14, an upstream flow channel 15, a downstream flow channel 16, and an outlet flow channel 17.

The inlet flow channel 13 is usable to supply the ink stored in the ink tank 12 to the connection flow channel 14. An end of the inlet flow channel 13 is detachably connected with the ink tank 12. The other end of the inlet flow channel 13 is connected with the connection flow channel 14. In this preferred embodiment, the inlet flow channel 13 includes a first inlet portion 13*a* and a second inlet portion 13*b*. The first inlet portion 13*a* includes the one end of the inlet flow channel 13. The first inlet portion 13*a* is detachably connected with the ink tank 12. The first inlet portion 13*a* is structured such that when the ink tank 12 is detached from the one end of the inlet flow channel 13, the ink does not leak from the one end of the inlet flow channel 13. The second inlet portion 13*b* includes the other end of the inlet flow channel 13. The second inlet portion 13*b* is connected with the connection flow channel 14.

The connection flow channel 14 is usable to supply the ink, supplied to the inlet flow channel 13, to the upstream flow channel 15. The connection flow channel 14 connects the inlet flow channel 13 and the upstream flow channel 15 to each other. One end of the connection flow channel 14 is connected with the other end of the inlet flow channel 13. In this preferred embodiment, a three-way valve 42 is provided at the one end of the connection flow channel 14. The one end of the connection flow channel 14 is connected with the other end of the inlet flow channel 13 via the three-way valve 42. The other end of the connection flow channel 14 is connected with the upstream flow channel 15. In this example, the connection flow channel 14 includes a first connection portion 14*a* and a second connection portion 14*b*. The first connection portion 14*a* includes the one end of the connection flow channel 14. The first connection portion 14*a* is connected with the second inlet portion 13*b* via the three-way valve 42. The second connection portion 14*b* includes the other end of the connection flow channel 14. The second connection portion 14*b* is connected with the upstream flow channel 15.

The upstream flow channel 15 allows the ink, supplied to the connection flow channel 14, to be supplied to the ink head 11. One end of the upstream flow channel 15 is connected with the other end of the connection flow channel 14. In this example, a three-way valve 43 is provided at the one end of the upstream flow channel 15. The one end of the upstream flow channel 15 is connected with the other end of the connection flow channel 14 via the three-way valve 43. The other end of the upstream flow channel 15 is connected with the ink head 11. In this preferred embodiment, the upstream flow channel 15 includes a first upstream portion 15*a*, a second upstream portion 15*b* and an upstream middle portion 15*c*. The first upstream portion 15*a* includes the one end of the upstream flow channel 15. The first upstream portion 15*a* is connected with the second connection portion 14*b* via the three-way valve 43. The second upstream portion 15*b* includes the other end of the upstream flow channel 15. The second upstream portion 15*b* is connected with the ink head 11. The upstream middle portion 15*c* is located between the first upstream portion 15*a* and the second upstream portion 15*b*. The upstream middle portion 15*c* is connected with the first upstream portion 15*a* and the second upstream portion 15*b*.

The downstream flow channel 16 is a flow channel from which the ink in the ink head 11 flows out. The downstream flow channel 16 allows the ink in the ink head 11 to flow into the connection flow channel 14. In this example, one end of the downstream flow channel 16 is connected with the ink head 11. The other end of the downstream flow channel 16 is connected with the one end of the connection flow channel 14. In more detail, the other end of the downstream flow channel 16 is connected with the one end of the connection flow channel 14 and the other end of the inlet flow channel 13 via the three-way valve 42. In this preferred embodiment, the downstream flow channel 16 includes a first downstream portion 16*a*, a second downstream portion 16*b* and a downstream middle portion 16*c*. The first downstream portion 16*a* includes the one end of the downstream flow channel 16. The first downstream portion 16*a* is connected with the ink head 11. The second downstream portion 16*b* includes the other end of the downstream flow channel 16. The second downstream portion 16*b* is connected with the second inlet portion 13*b* and the first connection portion 14*a* via the three-way valve 42. The downstream middle portion 16*c* is located between the first downstream portion 16*a* and the second downstream portion 16*b*. The downstream middle portion 16*c* is connected with the first downstream portion 16*a* and the second downstream portion 16*b*.

The outlet flow channel 17 is usable to discharge the ink in the inlet flow channel 13, the connection flow channel 14, the upstream flow channel 15 and the downstream flow channel 16 to outside. One end of the outlet flow channel 17 is connected with the other end of the connection flow channel 14. In more detail, the one end of the outlet flow channel 17 is connected with the other end of the connection flow channel 14 and the one end of the upstream flow channel 15 via the three-way valve 43. In this preferred embodiment, the other end of the outlet flow channel 17 is connected with an exhaust liquid tank 29. The exhaust liquid tank 29 is a tank to which the ink flowing in the ink flow channel 20 or the like of the ink supply system 10 is discharged.

In this preferred embodiment, the outlet flow channel 17 includes a first outlet portion 17*a*, a second outlet portion 17*b* and an outlet middle portion 17*c*. The first outlet portion 17*a* includes the one end of the outlet flow channel 17. The first outlet portion 17*a* is connected with the second connection portion 14*b* and the first upstream portion 15*a* via the three-way valve 43. The second outlet portion 17*b* includes the other end of the outlet flow channel 17. The second outlet portion 17*b* is connected with the exhaust liquid tank 29. The outlet middle portion 17*c* is located between the first outlet portion 17*a* and the second outlet portion 17*b*. The outlet middle portion 17*c* is connected with the first outlet portion 17*a* and the second outlet portion 17*b*.

In this preferred embodiment, the ink flow channel 20 includes a flexible tube. In more detail, the inlet flow channel 13, the connection flow channel 14, the upstream flow channel 15, the downstream flow channel 16 and the outlet flow channel 17 each include, for example, a flexible tube. There is no specific limitation on the type or material of any of the inlet flow channel 13, the connection flow channel 14, the upstream flow channel 15, the downstream flow channel 16 and the outlet flow channel 17.

The upstream pump 21 and the downstream pump 22 are usable to supply the ink. The upstream pump 21 is usable to supply the ink toward the ink head 11, and adjusts the flow rate of the ink to be supplied to the ink head 11. The downstream pump 22 is usable to circulate the ink flowing out of the ink head 11 to supply the ink to the connection flow channel 14. The downstream pump 22 adjusts the flow rate of the ink to be flowed out of the ink head 11. In this preferred embodiment, the upstream pump 21 is provided in the upstream flow channel 15. In more detail, the upstream pump 21 is provided between the first upstream portion 15*a* and the upstream middle portion 15*c*. The downstream pump 22 is provided in the downstream flow channel 16. In more detail, the downstream pump 22 is provided between the downstream middle portion 16*c* and the second downstream portion 16*b*. In this example, the ink head 11 is located between the upstream pump 21 and the downstream pump 22. Therefore, the flow rate of the ink is adjusted by the upstream pump 21, so that the pressure in the flow channel upstream with respect to the ink head 11 (in this example, the upstream flow channel 15) is adjusted, and the pressure in the flow channel downstream with respect to the ink head 11 (in this example, the downstream flow channel 16) is adjusted by the downstream pump 22. The pressure upstream and downstream with respect to the ink head 11 is adjusted in this manner, so that the pressure in the ink head 11 is adjusted. The ink is ejected in accordance with the pressure in the ink head 11.

In this preferred embodiment, the upstream pump 21 and the downstream pump 22 are preferably of the same type, for example. Alternatively, the upstream pump 21 and the downstream pump 22 may be of different types. In this example, the upstream pump 21 and the downstream pump 22 are diaphragm pumps. There is no specific limitation on the type of the upstream pump 21 or the downstream pump 22. Although not shown, the upstream pump 21 and the downstream pump 22 each include an elastically deformable diaphragm and a pump motor elastically deforming the diaphragm. The pump motor is driven to elastically deform the diaphragm, so that the upstream pump 21 and the downstream pump 22 adjust the flow rate of the ink. In this preferred embodiment, the expressions that "the upstream pump 21 is driven" and "the downstream pump 21 is driven" each refer to a state where the pump motor is driven and the diaphragm is elastically deformed.

In this preferred embodiment, for example, the upstream pump 21 includes a flow inlet (not shown) through which the ink flows in. The flow inlet of the upstream pump 21 may be provided with an upstream filter 44 that captures impurities such as sediment or the like in the ink flow channel 20. This significantly reduces or prevents an inconvenience that may be caused by entrance of the impurities to the upstream pump 21. Similarly, the downstream pump 22 includes a flow inlet (not shown) through which the ink flows in. The flow inlet of the downstream pump 22 may be provided with a downstream filter 45 that captures impurities in the ink flow channel 20. This significantly reduces or prevents an inconvenience that may be caused by entrance of the impurities to the downstream pump 22.

The upstream damper 23 and the downstream damper 24 alleviate a pressure change of the ink to stabilize an ink ejection operation of the ink head 11. The upstream damper 23 detects the flow rate of the ink flowing into the upstream damper 23. Based on the detection results of the flow rate of the ink made by the upstream damper 23, the driving on the upstream pump 21 is controlled. The downstream damper 24 detects the flow rate of the ink flowing into the downstream damper 24. Based on the detection results of the flow rate of the ink made by the downstream damper 24, the driving on the downstream pump 22 is controlled.

In this preferred embodiment, the upstream damper 23 is provided in the upstream flow channel 15. In more detail, the upstream damper 23 is provided in a portion of the upstream flow channel 15 closer to the ink head 11 than the upstream pump 21 is. In this preferred embodiment, the upstream damper 23 is provided between the upstream middle portion 15*c* and the second upstream portion 15*b* of the upstream flow channel 15. The downstream damper 24 is provided in the downstream flow channel 16. In more detail, the downstream damper 24 is provided in a portion of the downstream flow channel 16 closer to the ink head 11 than the downstream pump 22 is. In this preferred embodiment, the downstream damper 24 is provided between the first downstream portion 16*a* and the downstream middle portion 16*c* of the downstream flow channel 16.

In this preferred embodiment, for example, the upstream damper 23 and the downstream damper 24 each include an ink storage chamber 47 storing ink, and a detection sensor 48 that detects whether or not the amount of the ink in the ink storage chamber 47 is no more than the predetermined amount. The detection sensor 48 includes, for example, a photointerrupter. When, for example, the detection sensor 48 in the upstream damper 23 detects that the amount of the ink in the ink storage chamber 47 is less than, or equal to, the predetermined amount, the driving on the upstream pump 21 is controlled to increase the flow rate of the ink in the upstream pump 21. When the detection sensor 48 in the upstream damper 23 detects that the amount of the ink in the ink storage chamber 47 is greater than the predetermined amount, the driving on the upstream pump 21 is controlled to decrease the flow rate of the ink in the upstream pump 21.

Similarly, when the detection sensor 48 in the downstream damper 24 detects that the amount of the ink in the ink storage chamber 47 is less than, or equal to, the predetermined amount, the driving on the downstream pump 22 is controlled to increase the flow rate of the ink in the downstream pump 22. When the detection sensor 48 in the downstream damper 24 detects that the amount of the ink in the ink storage chamber 47 is greater than the predetermined amount, the driving on the downstream pump 22 is controlled to decrease the flow rate of the ink in the downstream pump 22.

The upstream damper 23 and the downstream damper 24 may be provided in one damper main body (not shown). A portion acting as the upstream damper 23 and a portion acting as the downstream damper 24 may be included in the damper main body so as not to overlap each other. In this preferred embodiment, the damper main body is provided on a top surface of the ink head 11 and is mounted on the carriage 4. Namely, as shown in FIG. 1, the upstream damper 23 and the downstream damper 24 are mounted on the carriage 4 together with the ink head 11. The upstream damper 23 and the downstream damper 24 are located above the ink head 11.

The upstream damper 23 may be provided with a damper filter (not shown) that captures impurities such as sediment or the like in the ink flow channel 20. This significantly reduces or prevents the impurities that may be contained in the ink from flowing into the second upstream portion 15*b* of the upstream flow channel 15 and the ink head 11. As shown in FIG. 2, the upstream damper 23 may include a thermistor 32 detecting the temperature of the ink in the upstream flow channel 15.

Now, the air trap unit 25 will be described. The air trap unit 25 collects air contained in the ink flowing in the ink supply system 10. The air trap unit 25 discharges the air in the air trap unit 25 outside. In this preferred embodiment, the air trap unit 25 preferably is provided in the connection flow channel 14, for example. In more detail, the air trap unit 25 is preferably provided in the middle of the connection flow channel 14, more specifically, between the first connection portion 14*a* and the second connection portion 14*b*.

Figure 3:
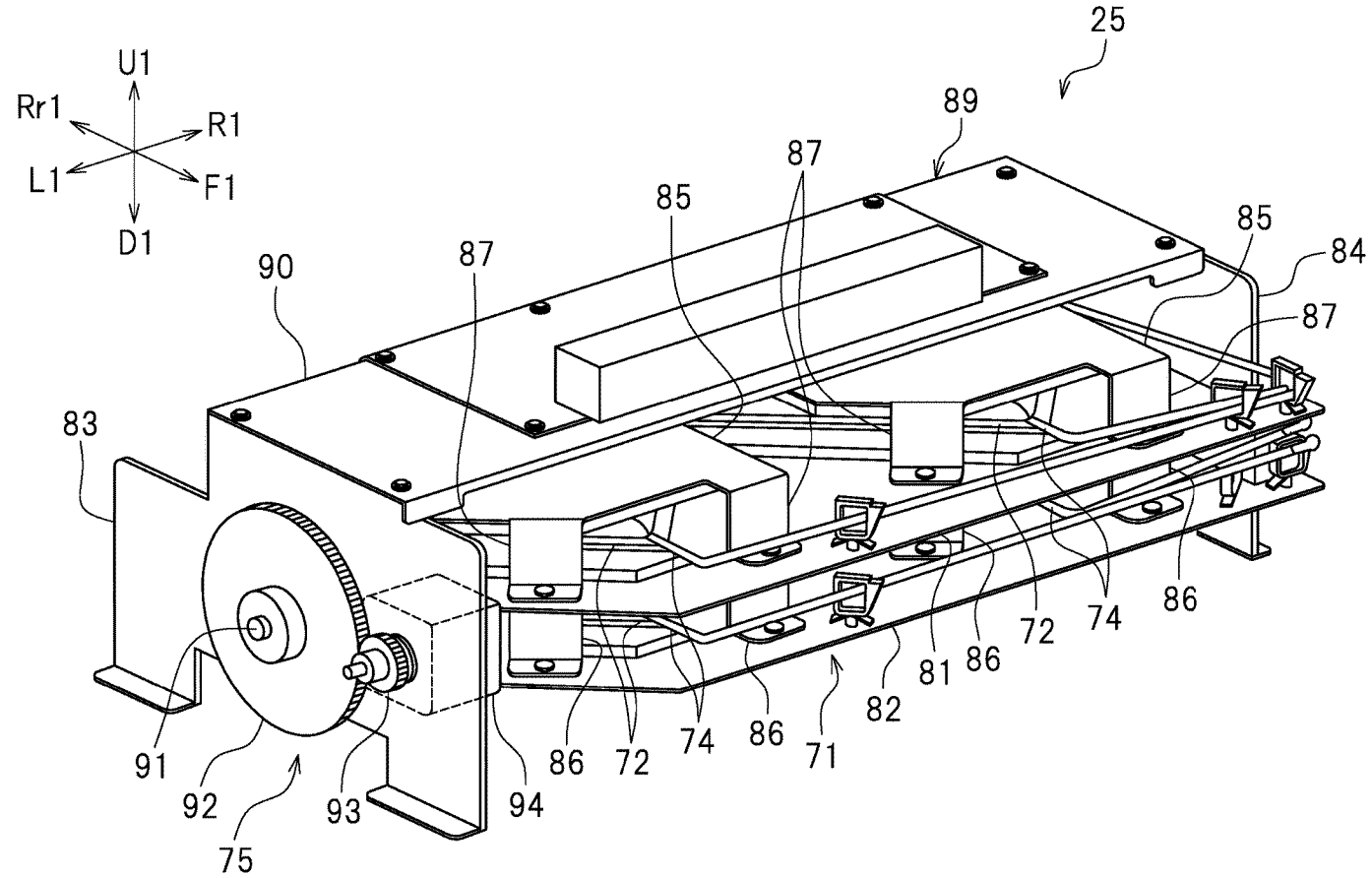
FIG. 3 is a perspective view of an air trap unit.
Figure 4:
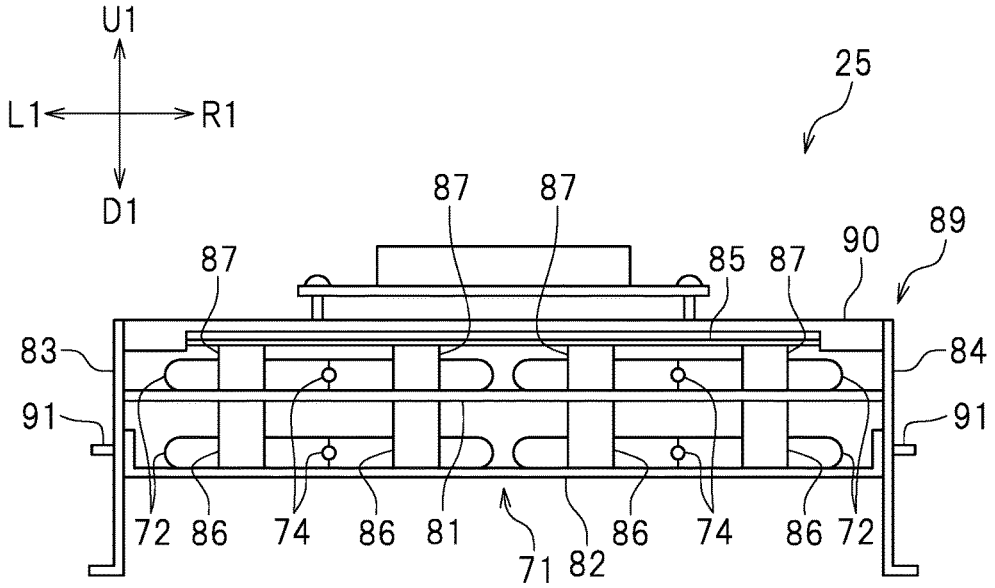
FIG. 4 is a schematic front view of the air trap unit.
Figure 5:
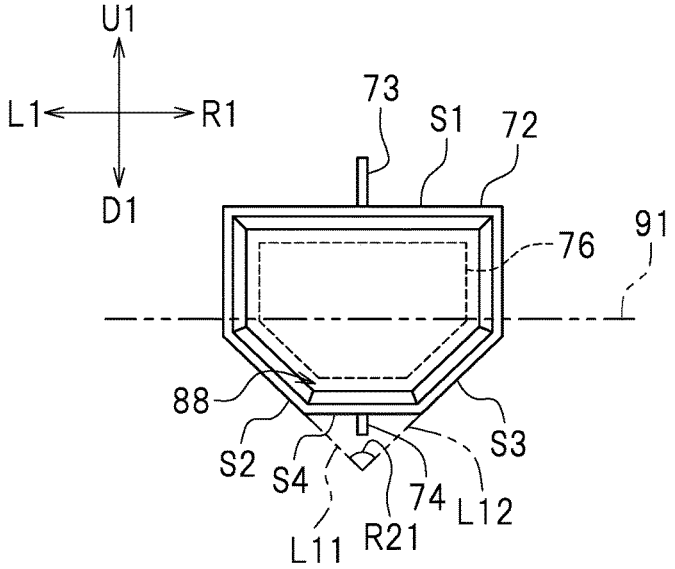
FIG. 5 is a plan view of an air trap container.

FIG. 3 is a perspective view of the air trap unit 25. FIG. 4 is a schematic front view of the air trap unit 25. FIG. 5 is a plan view of an air trap container 72. In the following description, the term "height" refers to the length in the gravitational direction (vertical direction) of the ink supply system 10 and the air trap unit 25 when the ink supply system 10 and the air trap unit 25 are located properly at a predetermined attitude at a predetermined position. In the drawings regarding the air trap unit 25, reference signs F1, Rr1, L1, R1, U1 and D1 respectively represent "front", "rear", "left", "right", "up" and "down" as seen in a front view of the air trap unit 25.

In this preferred embodiment, as shown in FIG. 3, the air trap unit 25 includes a main body 71, the air trap containers 72, flow inlets 73 (see FIG. 5), flow outlets 74 (see FIG. 5), an inclination mechanism 75, and a heater 76 (see FIG. 5). The air trap containers 72 are placed on the main body 71. The main body 71 is inclinable by the inclination mechanism 75. In this preferred embodiment, as described above, the printer 100 preferably includes, for example, eight ink supply systems 10 as shown in FIG. 1. One main body 71 is provided for each four ink supply systems 10 out of the eight ink supply systems 10. The four ink supply systems 10 in the air trap unit 25 include a common main body 71. Thus, in this example, two main bodies 71 are provided in the printer 100. There is no specific limitation on the number of the main bodies 71 provided in the printer 100. For example, one main body 71 may be provided for one ink supply system 10 in the air trap unit 25. In this case, eight main bodies 71 may be provided in the printer 100. For example, all the eight ink supply systems 10 in the air trap unit 25 may include a common main body 71. In this case, one main body 71 is provided in the printer 100.

In this preferred embodiment, as shown in FIG. 4, the main body 71 includes a first carrying portion 81, a second carrying portion 82, a ceiling 85, a plurality of first coupling plates 86, and a plurality of second coupling plates 87. The first carrying portion 81 and the second carrying portion 82 are each preferably a plate-shaped member, for example. The first carrying portion 81 and the second carrying portion 82 are arrayed in an up-down direction. The first carrying portion 81 is located above the second carrying portion 82. On each of the first carrying portion 81 and the second carrying portion 82, the air trap containers 72 are placed. In other words, the air trap containers 72 are accommodated between the first carrying portion 81 and the ceiling 85, and between the first carrying portion 81 and the second carrying portion 82. In this example, on the first carrying portion 81, the air trap containers 72 of two ink supply systems 10, among the four ink supply systems 10, are placed. On the second carrying portion 82, the air trap containers 72 of the remaining two ink supply systems 10, among the four ink supply systems 10, are placed. In this preferred embodiment, two air trap containers 72 placed on the first carrying portion 81 are arrayed in the left-right direction, and the two air trap containers 72 placed on the second carrying portion 82 are arrayed in the left-right direction. There is no specific limitation on the number of the air trap containers 72 to be placed on the first carrying portion 81 or the second carrying portion 82, the positions of the air trap containers 72, or the like. In this preferred embodiment, the first carrying portion 81 and the second carrying portion 82 are coupled with each other by a plurality of first coupling plates 86.

As shown in FIG. 4, the ceiling 85 is provided above the first carrying portion 81 so as to be parallel or substantially parallel to the first carrying portion 81 and the second carrying portion 82. In this example, the ceiling 85 and the first carrying portion 81 are coupled with each other by the plurality of second coupling plates 87.

In this preferred embodiment, the main body 71 is accommodated in an accommodation portion 89 including an inner space. The main body 71 is rotatable with respect to the accommodation portion 89. In this example, the accommodation portion 89 includes a left wall 83, a right wall 84, and a top wall 90. The left wall 83 extends in the up-down direction. The main body 71 is located to the right of the left wall 83. The right wall 84 is located to face the left wall 83 in the left-right direction. The right wall 84 extends in the up-down direction. In this example, the main body 71 is located to the left of the right wall 83. The top wall 90 extends in the left-right direction. A left end of the top wall 90 is connected with the left wall 83. A right end of the top wall 90 is connected with the right wall 84. The main body 71 is located below the top wall 90. In this preferred embodiment, the main body 71 is located in a space enclosed by the left wall 83, the right wall 84 and the top wall 90.

As shown in FIG. 5, the air trap container 72 temporarily stores the ink and the air contained in the ink. In this preferred embodiment, the air trap container 72 temporarily stores the ink in the ink flow channel 20 and the air contained in the ink. In this preferred embodiment, one air trap container 72 is provided for each ink supply system 10. Therefore, the printer 100 includes eight air trap containers 72. Alternatively, the air supply systems 10 in which the same color of ink flows may include a common air trap container 72. The air trap container 72 is a pouch. In this preferred embodiment, the air trap container 72 is preferably made of a flexible material. The air trap container 72 is preferably made of, for example, polyethylene.

Figure 6:
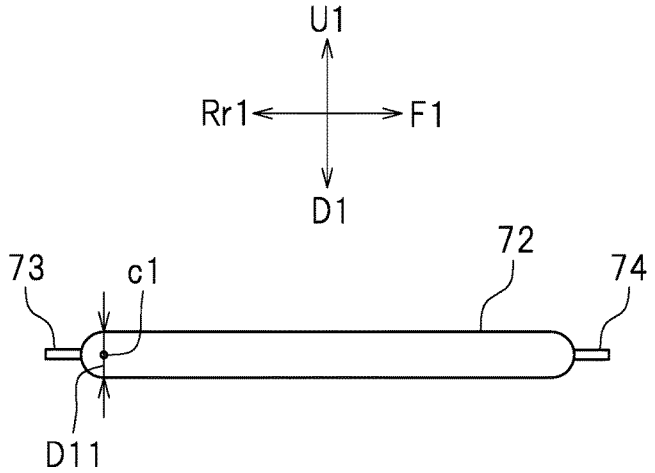
FIG. 6 is a left side view of the air trap container.

FIG. 6 is a left side view of the air trap container 72. As shown in FIG. 6, the air trap container 72 is flat, and when being placed on the main body 71, expands on a top surface of the first carrying portion 81 (or the second carrying portion 82). As shown in FIG. 5, the air trap container 72 is hexagonal as seen in a plan view. There is no specific limitation on the shape of the air trap container 72.

The ink and the air contained in the ink flow into the air trap container 72 through the flow inlet 73. The flow inlet 73 is provided in the air trap container 72. In this preferred embodiment, the flow inlet 73 is provided at a center or approximate center of a side S1 of the hexagonal air trap container 72 as seen in a plan view. In more detail, the flow inlet 73 is provided at the center or approximate center of the side S1 rearmost among the sides of the hexagonal air trap container 72 as seen in a plan view. As shown in FIG. 6, the flow inlet 73 is provided on a side surface of the air trap container 72, at a center c1 in a thickness direction D11 of the air trap container 72. In this example, the air trap container 72 is located such that the flow inlet 73 is directed rearward. Although not shown, the flow inlet 73 is in communication with the first connection portion 14*a* (see FIG. 2) of the connection flow channel 14. In this example, the first connection portion 14*a* of the connection flow channel 14 and the inside of the air trap container 72 are in communication with each other via the flow inlet 73.

The ink and the air in the air trap container 72 flow out through the flow outlet 74. As shown in FIG. 5, the flow outlet 74 is provided in the air trap container 72. In this preferred embodiment, the flow outlet 74 is provided in the air trap container 72 to face the flow inlet 73 in the front-rear direction as seen in a plan view. In this preferred embodiment, the flow outlet 74 is provided on a side S4 of the hexagonal air trap container 72 as seen in a plan view. In more detail, the flow outlet 74 is located on the side S4 foremost among the sides of the hexagonal air trap container 72 as seen in a plan view. The side S4 faces the side S1, in which the flow inlet 73 is provided, in the front-rear direction. The side S4 is preferably parallel or substantially parallel to the side S1. In this preferred embodiment, where the sides of the air trap container 72 adjacent to the side S4 in which the flow outlet 74 is provided are a first side S2 and a second side S3, a first line L11 extending from the first side S2 and a second line L12 extending from the second side S3 define an angle R21 of 90 degrees. The expression that "the angle R21 is 90 degrees" encompasses a slight tolerance. In this example, as shown in FIG. 6, the flow outlet 74 is provided on a side surface of the air trap container 72, at the center c1 in the thickness direction D11 of the air trap container 72. Alternatively, the flow outlet 74 may be provided in the side surface of the air trap container 72, below the center c1. Still alternatively, the flow outlet 74 may be provided in the side surface of the air trap container 72, above the center c1. In this example, the air trap container 72 is located such that the flow outlet 74 is directed frontward. Although not shown, the flow outlet 74 is in communication with the second connection portion 14*b* (see FIG. 2) of the connection flow channel 14. In this example, the second connection portion 14*b* of the connection flow channel 14 and the inside of the air trap container 72 are in communication with each other via the flow outlet 74.

In this preferred embodiment, as shown in FIG. 5, the air trap container 72 includes a collection portion 88. The collection portion 88 collects the air in the air trap container 72 when the inclining state of the air trap container 72 is a discharge state M2 described below. The collection portion 88 is in communication with the flow outlet 74. In this example, the collection portion 88 is in the vicinity of the flow outlet 74. In more detail, the collection portion 88 is between the first side S2 and the second side S3, of the air trap container 72, which are adjacent to the side S4 in which the flow outlet 74 is provided. In this preferred embodiment, the distance between the sides S2 and S3 adjacent to the side S4 in which the flow outlet 74 is provided is decreased toward the flow outlet 74. Therefore, as seen in a plan view, the collection portion 88 has a width narrowing toward the flow outlet 74. There is no specific limitation on the shape of the collection portion 88. The collection portion 88 may have any shape as long as the air in the air trap container 72 is collected in the collection portion 88 when the inclination state of the air trap container 72 is the discharge state M2.

Figure 7:
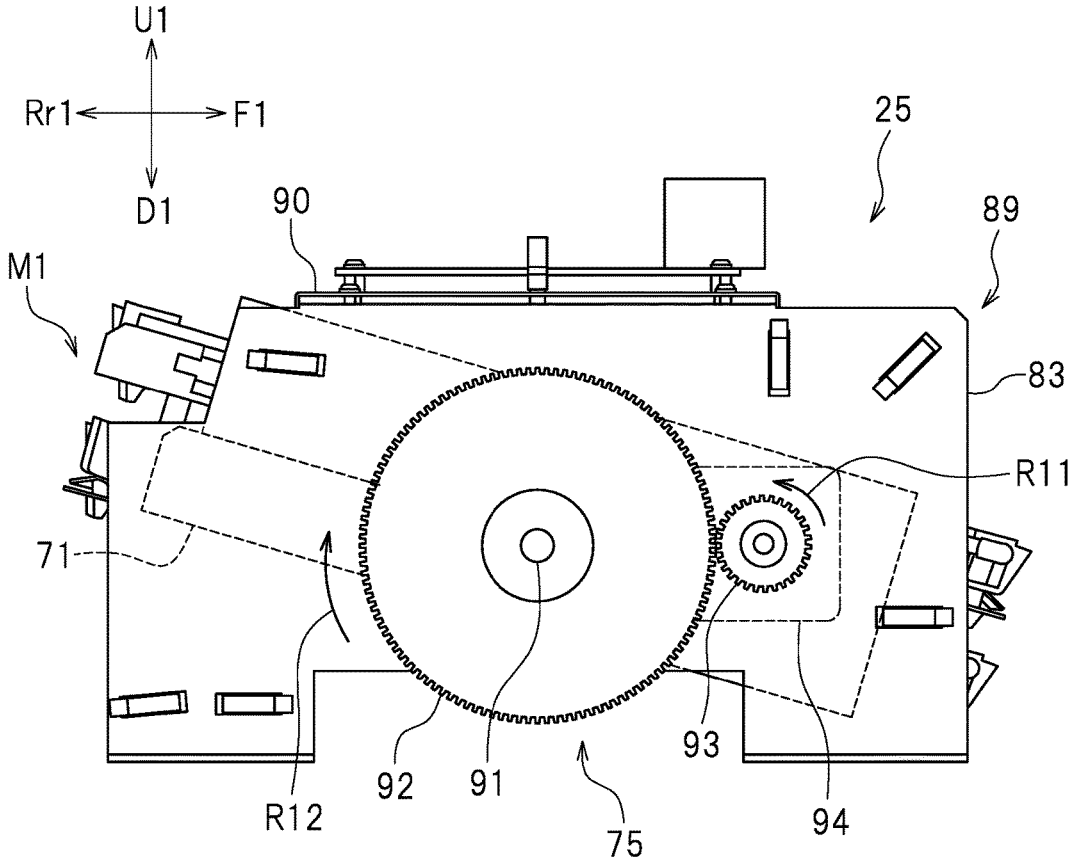
FIG. 7 is a left side view of the air trap unit in the case where an inclination state of the air trap container is a collection state.
Figure 8:
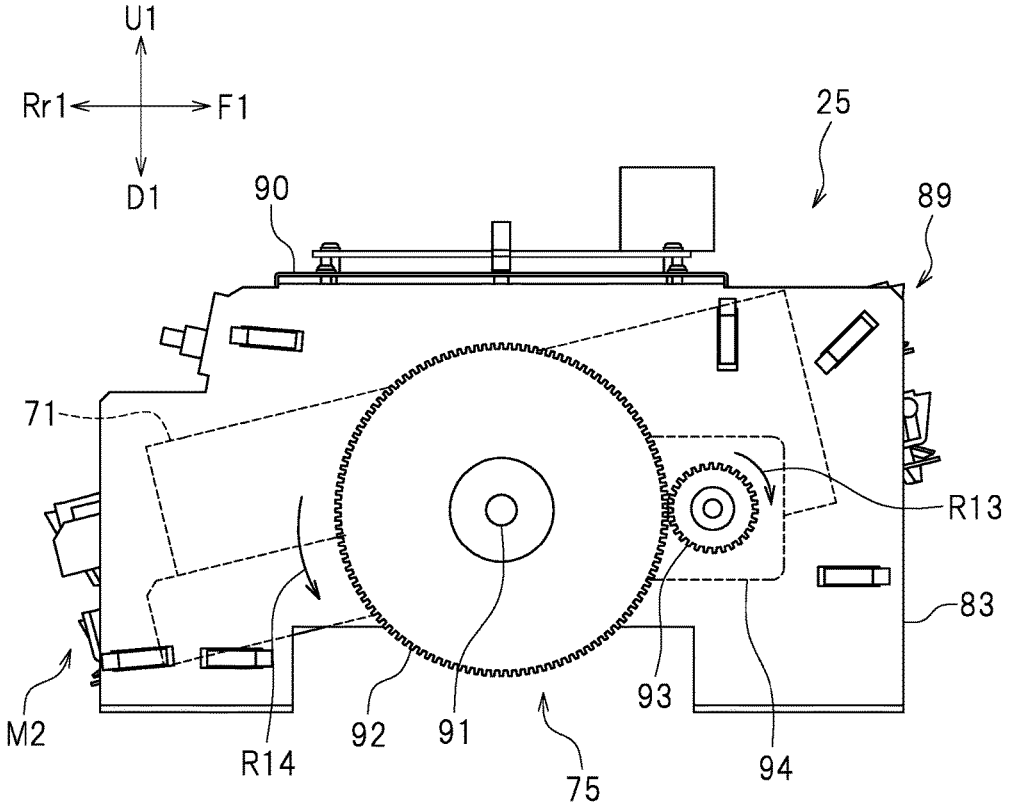
FIG. 8 is a left side view of the air trap unit in the case where the inclination state of the air trap container is a discharge state.
Figure 9:
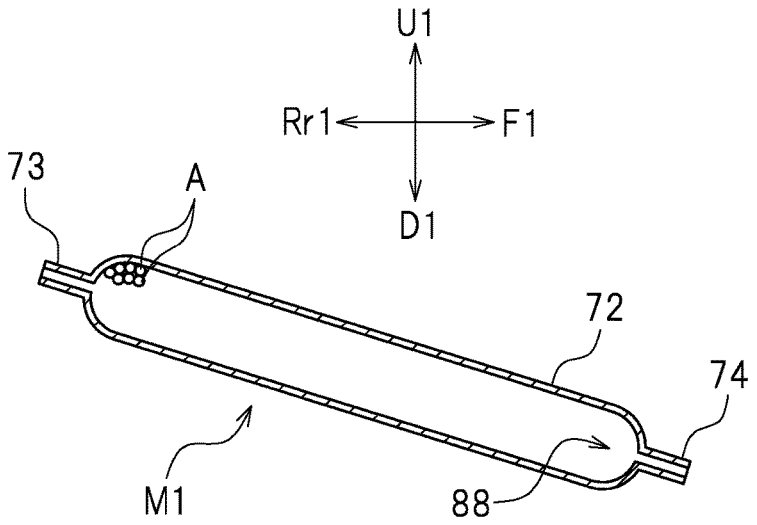
FIG. 9 is a side cross-sectional view of the air trap container in the collection state.

FIG. 7 is a left side view of the air trap unit 25 when the inclination state of the air trap container 72 is a collection state M1. FIG. 8 is a left side view of the air trap unit 25 when the inclination state of the air trap container 72 is the discharge state M2. In this preferred embodiment, the inclination state of the air trap container 72 may be either the collection state M1 (see FIG. 7) or the discharge state M2 (see FIG. 8) in accordance with the manner of inclination of the air trap container 72. As shown in FIG. 7, the collection state M1 is a state where the air is collected to the air trap container 72. FIG. 9 is a side cross-sectional view of the air trap container 72 in the collection state M1. In this example, as shown in FIG. 9, the collection state M1 is a state where the air trap container 72 is inclined such that the flow inlet 73 is above the flow outlet 74. In other words, the collection state M1 is a state where the air trap container 72 is inclined such that the rear end of the air trap container 72 is at a level higher than that of the front end thereof. In this preferred embodiment, the collection state M1 may encompass an inclination state where the flow inlet 73 is at the same level as that of the flow outlet 74, namely, a state where the air trap container 72 is horizontal. In this preferred embodiment, the collection state M1 corresponds to the "first state".

Figure 10:
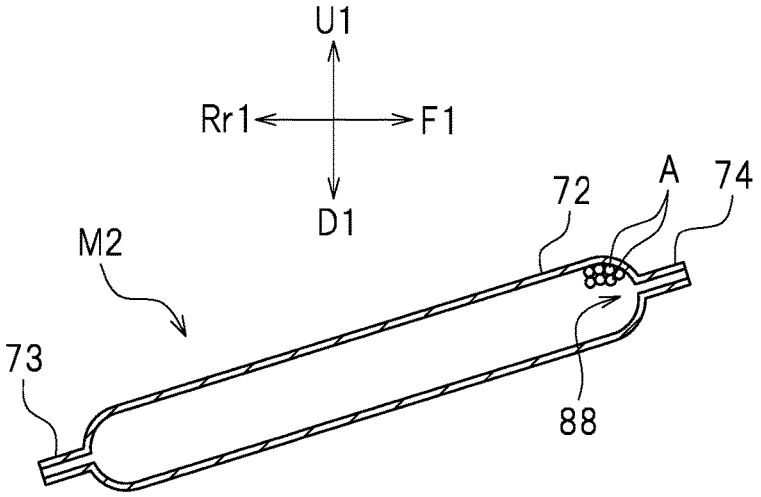
FIG. 10 is a side cross-sectional view of the air trap container in the discharge state.

As shown in FIG. 8, the discharge state M2 is a state where the air in the air trap container 72 is discharged outside together with the ink in the air trap container 72. FIG. 10 is a side cross-sectional view of the air trap container 72 in the discharge state M2. In this example, as shown in FIG. 10, the discharge state M2 is a state where the air trap container 72 is inclined such that the flow outlet 74 is above the flow inlet 73. In other words, the discharge state M2 is a state where the air trap container 72 is inclined such that the front end of the air trap container 72 is at a level higher than that of the rear end thereof. In this preferred embodiment, the discharge state M2 corresponds to the "second state".

The inclination mechanism 75 inclines the air trap container 72 such that the air trap container 72 is put into either the collection state M1 or the discharge state M2. In this preferred embodiment, the inclination mechanism 75 inclines the main body 71 to incline the air trap container 72. Alternatively, the inclination mechanism 75 may directly incline the air trap container 72. In this example, as described above, the air trap containers 72 of the four ink supply systems 10 are placed on one main body 71. Therefore, one inclination mechanism 75 inclines four air trap containers 72 at the same time. In this preferred embodiment, one inclination mechanism 75 is preferably provided for each main body 71. In this example, one inclination mechanism 75 is provided for four ink supply systems 10. The four ink supply systems 10 preferably include a common inclination mechanism 75. Alternatively, one inclination mechanism 75 may be provided for each ink supply system 10. For example, one inclination mechanism 75 may incline one air trap container 72. FIG. 4 does not show the inclination mechanism 75. There is no specific limitation on the specific structure of the inclination mechanism 75. In this preferred embodiment, as shown in FIG. 7, the inclination mechanism 75 includes a rotation shaft 91, a first gear 92, a second gear 93, and a driving motor 94.

The rotation shaft 91 is a center of the inclination of the air trap container 72. In this example, the main body 72 is inclined about the rotation shaft 91, and thus the air trap container 72 is inclined. The rotation shaft 91 is provided on the main body 71. The rotation shaft 91 extends in the left-right direction. As seen in a plan view, the rotation shaft 91 is located between the flow inlet 73 and the flow outlet 74 of each of the four air trap containers 72. Alternatively, as seen in a plan view, the rotation shaft 91 may be located to the rear of the flow inlet 73. The rotation shaft 91 may be located to the front of the flow outlet 74. In this preferred embodiment, the rotation shaft 91 is located to run through a central portion of the left side wall 83 of the accommodation portion 89, and is rotatable with respect to the accommodation portion 89. The rotation shaft 91 is located between the first carrying portion 81 and the second carrying portion 82.

The first gear 92 is rotatable together with the rotation shaft 91. The first gear 92 is provided on the rotation shaft 91. In this preferred embodiment, the first gear 92 is provided at a left end of the rotation shaft 91. Alternatively, the first gear 92 may be provided at a right end of the rotation shaft 91. The second gear 93 is located to the front of the first gear 92, and is in engagement with the first gear 92. The second gear 93 is smaller than the first gear 92.

The driving motor 94 rotates the rotation shaft 91. The driving motor 94 is driven to rotate the rotation shaft 91, so that the air trap container 72 is inclined together with the main body 71. In this preferred embodiment, the driving motor 94 is connected with the second gear 93. The driving motor 94 is driven, so that the second gear 93 rotates. The rotation of the second gear 93 rotates the rotation shaft 91 together with the first gear 92. In this example, the second gear 93 is a driving gear, and the first gear 92 is a subordinate gear. For example, the driving motor 94 is driven to rotate the second gear 93 in a counterclockwise direction R11, so that the first gear 92 and the rotation shaft 91 rotate in a clockwise direction R12. At this point, as shown in FIG. 9, the air trap container 72 and the main body 71 are inclined such that the flow inlet 73 of the air trap container 72 is at a level higher than that of the flow outlet 74, so that the air trap container 72 is put into the collection state M1. By contrast, as shown in FIG. 8, the driving motor 94 is driven to rotate the second gear 93 in a clockwise direction R13, so that the first gear 92 and the rotation shaft 91 rotate in a counterclockwise direction R14. At this point, as shown in FIG. 10, the air trap container 72 and the main body 71 are inclined such that the flow outlet 74 is at a level higher than that of the flow inlet 73, so that the air trap container 72 is put into the discharge state M2.

As shown in FIG. 5, a heater 76 warms the ink in the air trap container 72. In this preferred embodiment, the heater 76 is provided below the air trap container 72. In more detail, in the case where the air trap container 72 is provided on the first carrying portion 81, the heater 76 is provided between the air trap container 72 and the first carrying portion 81. In the case where the air trap container 72 is provided on the second carrying portion 82, the heater 76 is provided between the air trap container 72 and the second carrying portion 82.

In this preferred embodiment, as shown in FIG. 2, the air trap unit 25 may include a thermistor 35*a*. The thermistor 35*a* detects the temperature of the ink in the air trap container 72 of the air trap unit 25. For example, in the case where the thermistor 35*a* detects that the temperature of the ink in the air trap container 72 is lower than, or equal to, a predetermined temperature, the heater 76 is controlled to warm the ink in the air trap container 72.

The air trap unit 25 has been described. Now, the inlet valve 26 and the outlet valve 27 will be described. The inlet valve 26 opens and closes the inlet flow channel 13. The inlet valve 26 opens the inlet flow channel 13, so that the ink stored in the ink tank 12 is supplied to the ink head 11. The inlet valve 26 closes the inlet flow channel 13, so that the ink stored in the ink tank 12 is prohibited from flowing into the ink head 11. In this preferred embodiment, the term "open" encompasses a state where the flow channel to be opened or closed is completely opened and also a state where the flow channel to be opened or closed is not completely opened and but is partially opened. Where the state in which the flow channel to be opened or closed is completely opened is 100%, the term "open" may encompass a state where the flow channel to be opened or closed is opened about 80% or about 90%, for example. Depending on the structure of the ink supply system 10, the term "open" may encompass a state where the flow channel is opened, for example, about 10%. In this preferred embodiment, the term "close" is preferably a state where the flow channel to be opened or closed is completely closed. Depending on the structure of the ink supply system 10, the term "close" may encompass a state where a tiny portion of the flow channel to be opened or closed is opened. Where the state in which the flow channel to be opened or closed is completely opened is 100%, the term "close" may encompass a state where the flow channel to be opened or closed is opened, for example, about 1% depending on the structure of the ink supply system 10. In this preferred embodiment, the inlet valve 26 is provided in the inlet flow channel 13. In more detail, the inlet valve 26 is provided between the first inlet portion 13*a* and the second inlet portion 13*b* of the inlet flow channel 13. There is no specific limitation on the type of the inlet valve 26. In this example, the inlet valve 26 is a choke valve.

The outlet valve 27 opens and closes the outlet flow channel 17. The outlet valve 27 opens the outlet flow channel 17, so that the ink in the ink flow channel 20 is discharged outside. The outlet valve 27 closes the outlet flow channel 17, so that the ink in the ink flow channel 20 is prohibited from being discharged outside. In this preferred embodiment, the outlet valve 27 is provided in the outlet flow channel 17. In more detail, the outlet valve 27 is provided between the first outlet portion 17*a* and the outlet middle portion 17*c* of the outlet flow channel 17. There is no specific limitation on the type of the outlet valve 27. In this preferred embodiment, the outlet valve 27 is a choke valve like the inlet valve 26. The outlet valve 27 may be of the same type as that of the inlet valve 26, or may be of a different type from that of the inlet valve 26.

The outlet pump 28 supplies the ink in the ink flow channel 20 or the air contained in the ink to the exhaust liquid tank 29 in the state where the outlet valve 27 opens the outlet flow channel 17. The outlet pump 28 is provided in the outlet flow channel 17. In more detail, the outlet pump 28 is provided in a portion of the outlet flow channel 17 closer to the exhaust liquid tank 29 than the outlet valve 27 is. In this preferred embodiment, the outlet pump 28 is provided between the outlet middle portion 17*c* and the second outlet portion 17*b* of the outlet flow channel 17. There is no specific limitation on the type of the outlet pump 28. In this example, the outlet pump 28 preferably is a tube pump. Although not shown, the outlet pump 28 is connected with a motor. The motor is driven to drive the outlet pump 28.

Figure 11:
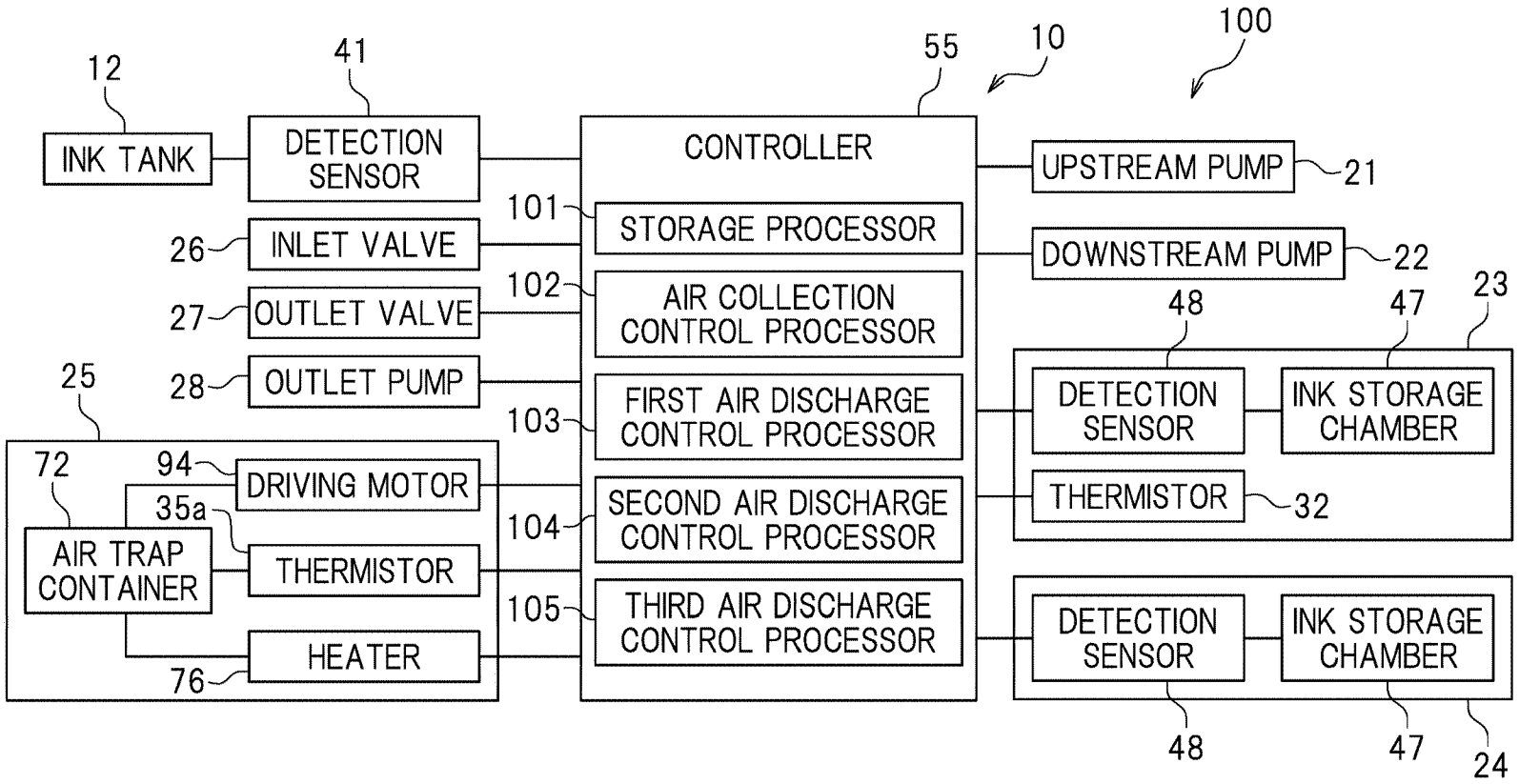
FIG. 11 is a block diagram of the printer.

FIG. 11 is a block diagram of the printer 100. In this preferred embodiment, as shown in FIG. 11, the ink supply system 10 includes a controller 55. The controller 55 executes controls on the ink supply system 10. In this example, the controller 55, for example, controls the supply of the ink to the ink head 11. There is no specific limitation on the structure of the controller 55. For example, the controller 55 may be a computer, and may include a central processing unit (hereinafter, referred to as a "CPU"), a ROM storing a program to be executed by the CPU, a RAM, and the like.

The controller 55 is connected with the detection sensor 41 provided in the ink tank 12, and detects the amount of the ink stored in the ink tank 12 by use of the detection sensor 41. The controller 55 is connected with the upstream pump 21 and the detection sensor 48 of the upstream damper 23. The detection sensor 48 of the upstream damper 23 detects the amount of the ink in the ink storage chamber 47 of the upstream damper 23, and the controller 55 controls the driving on the upstream pump 21 based on the detection results. The controller 55 is connected with the downstream pump 22 and the detection sensor 48 of the downstream damper 24. The detection sensor 48 of the downstream damper 24 detects the amount of the ink in the ink storage chamber 47 of the downstream damper 24, and the controller 55 controls the driving on the downstream pump 22 based on the detection results.

The controller 55 is connected with the thermistor 32 provided in the upstream damper 23, and detects the temperature of the ink in the upstream flow channel 15 by use of the thermistor 32. The controller 55 is connected with the driving motor 94 of the inclination mechanism 75 of the air trap unit 25, and controls the driving motor 94 to put the air trap container 72 into either the collection state M1 or the discharge state M2. The controller 55 is connected with the thermistor 35*a* provided in the air trap unit 25, and detects the temperature of the ink in the air trap container 72 by use of the thermistor 35*a*. The controller 55 is connected with the heater 76 of the air trap unit 25, and controls the heater 76 to warm the ink in the air trap container 72. The controller 55 is connected with the inlet valve 26, and controls the inlet valve 26 to open or close the inlet flow channel 13. The controller 55 is connected with the outlet valve 27, and controls the outlet valve 27 to open or close the outlet flow channel 17. The controller 55 is connected with the outlet pump 28, and controls the outlet pump 28 to discharge the ink in the inlet flow channel 20 and the air stored in the air trap container 72 of the air trap unit 25 to the exhaust liquid tank 29.

In this preferred embodiment, the controller 55 includes a storage processor 101, an air collection control processor 102, a first air discharge control processor 103, a second air discharge control processor 104, and a third air discharge control processor 105. Specific controls on each of the components described above will be described below.

The structure of the printer 100 including the ink supply system 10 according to this preferred embodiment has been described. Now, control executed by the controller 55 in the case where the inclination state of the air trap container 72 of the air trap unit 25 is the collection state M1 (see FIG. 7). The air trap container 72 is in the collection state M1 while not in the discharge state M2, for example, at the time of printing or at the time of waiting for printing. For example, at the time of printing, the air collection control processor 102 controls the driving motor 94 such that the air trap container 72 is put into the collection state M1 as shown in FIG. 9. Namely, the air collection control processor 102 controls the driving motor 94 of the inclination mechanism 75 such that the flow inlet 73 is at a level higher than that of the flow outlet 74. As shown in FIG. 2, at the time of printing, the ink is ejected from the nozzle 11*a* of the ink head 11 toward the recording medium 5 placed on the platen 7. At the time of printing, the ink stored in the ink tank 12 is supplied to the ink head 11. At this point, the controller 55 opens the inlet valve 26 and closes the outlet valve 27. As a result, the inlet flow channel 12 is opened, and the outlet flow channel 17 is closed. At the time of printing, the controller 55 drives the upstream pump 21 and the downstream pump 22. In more detail, the controller 55 controls the driving on the upstream pump 21 and the downstream pump 22 such that the pressure of the ink head 11 is negative. As a result, the ink is ejected from the nozzle 11*a* of the ink head 11.

In this preferred embodiment, at the time of printing, the inlet valve 26 is opened. Therefore, the ink stored in the ink tank 12 flows into the connection flow channel 14 via the inlet flow channel 13. The outlet valve 27 is closed, and the upstream pump 21 and the downstream pump 22 are driven. Therefore, the ink in the connection flow channel 14 does not flow into the outlet flow channel 17, but flows into the upstream flow channel 15. The upstream pump 21 is driven, and thus the ink in the upstream flow channel 15 is supplied to the ink head 11. The ink head 11 is in a negative pressure state. Therefore, a portion of the ink in the ink head 11 is ejected from the nozzle 11*a* toward the recording medium 5. At this point, the downstream pump 22 is driven, and thus the remaining portion of the ink in the ink head 11 flows into the downstream flow channel 16. The ink in the downstream flow channel 16 flows into the connection flow channel 14. In this manner, at the time of printing, the ink circulates in the ink flow channel 20 while flowing in the connection flow channel 14, the upstream flow channel 15, the ink head 11 and the downstream flow channel 16.

The ink flowing into the connection flow channel 14 flows from the first connection portion 14*a* via the flow inlet 73 of the air trap unit 25 to the air trap container 72. At this point, as shown in FIG. 9, the air trap container 72 is in the collection state M1. In the case where air is mixed in the ink, the air is collected to a portion of the air trap container 72 that is in the vicinity of the flow inlet 73 because the air is more lightweight than the ink. In FIG. 9 and FIG. 10, letter A represents the air. The ink in the air trap container 72 flows out to the second connection portion 14*b* of the connection flow channel 14 through the flow outlet 74 in the state of not containing air.

Figure 12:
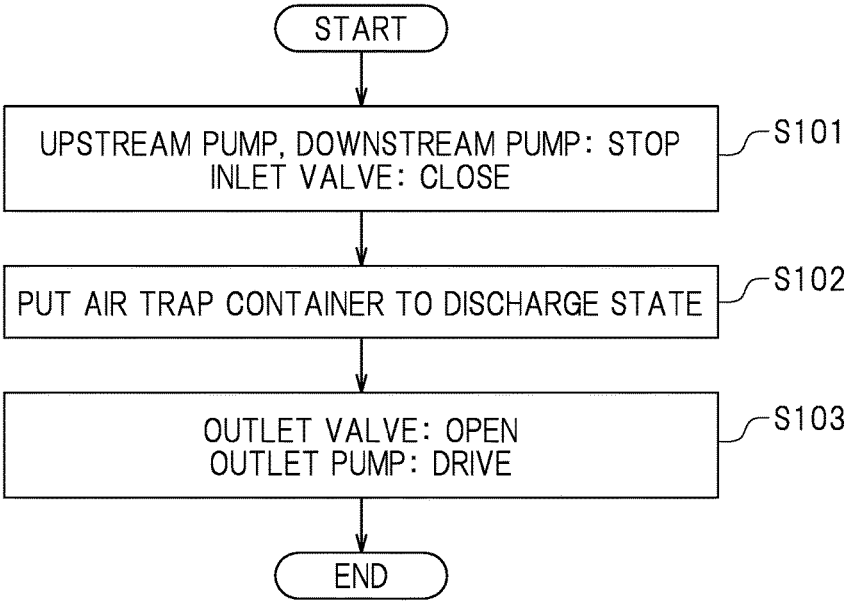
FIG. 12 is a flowchart showing a procedure of control executed by a controller to put the air trap container into the discharge state.
Figure 13:
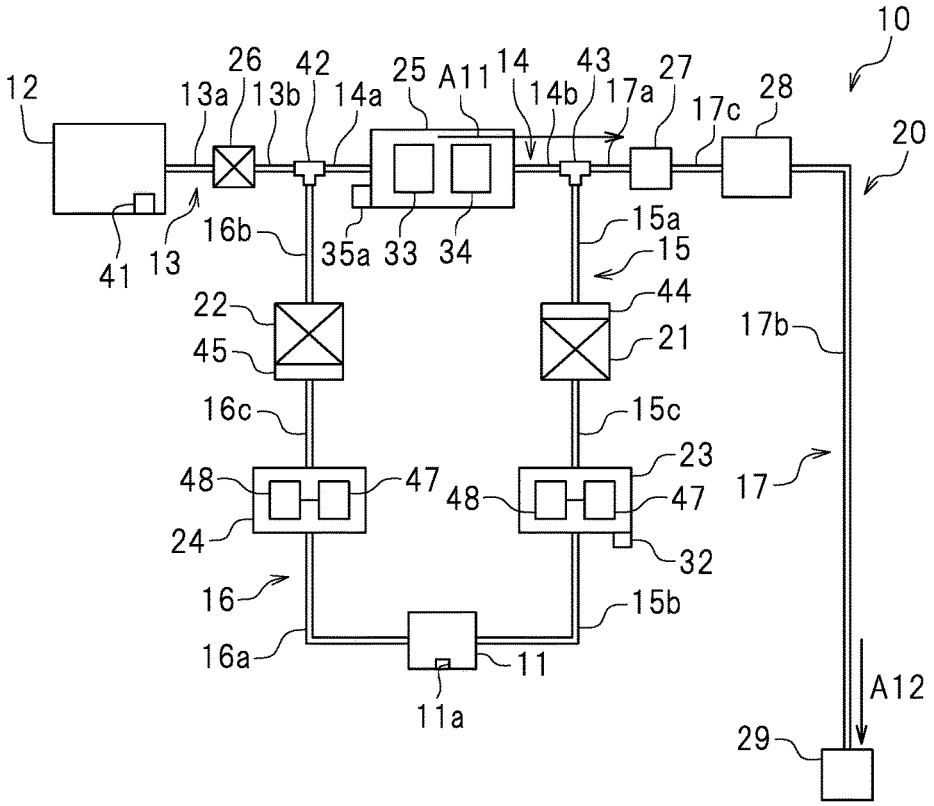
FIG. 13 is a schematic view showing the ink supply system in the discharge state.

Now, control executed by the controller 55 to put the air trap container 72 into the discharge state M2 and discharging the air in the air trap container 72 outside will be described. FIG. 12 is a flowchart showing a procedure of control executed by the controller 55 to put the air trap container 72 into the discharge state M2. FIG. 13 is a schematic view of the ink supply system 10 in the discharge state M2. In FIG. 13, "X" used for the inlet valve 26 indicates that the inlet valve 26 is closed. "X" used for each of the upstream pump 21 and the downstream pump 22 indicates that each of the upstream pump 21 and the downstream pump 22 is in a pause. In FIG. 13, the arrows represent the flow of the ink. Now, the control executed at the time of printing in order to transfer the state where the upstream pump 21 and the downstream pump 22 are driven to the state where the air in the air trap container 72 is discharged outside will be described, with reference to the flowchart in FIG. 12.

In this preferred embodiment, as shown in FIG. 12, first in step S101, the first air discharge control processor 103 controls the upstream pump 21 and the downstream pump 22 to stop and controls the inlet valve 26 to be closed. The first air discharge control processor 103 may control the inlet valve 26 to be opened. At this point, as shown in FIG. 13, the upstream pump 21 and the downstream pump 22 are in a pause state. Therefore, the ink does not circulate in the ink flow channel 20, and the ink in the connection flow channel 14 does not flow into the upstream flow channel 15 or the downstream flow channel 16.

Next, in step S102 in FIG. 12, after the control by the first air discharge control processor 103 is executed, the second air discharge control processor 104 controls the inclination mechanism 75 to put the air trap container 72 into the discharge state M2. Specifically, the second air discharge control processor 104 drives the driving motor 94 such that the second gear 93 rotates in the clockwise direction R13 as shown in FIG. 8. At this point, the second gear 93 rotates in the clockwise direction R13, and the first gear 92 engaged with the second gear 93 rotates in the counterclockwise direction R14. Along with the rotation of the first gear 92 in the counterclockwise direction R14, the rotation shaft 91 rotates in the counterclockwise direction R14. When the rotation shaft 91 rotates in the counterclockwise direction R14 and as a result, the flow outlet 74 is put to a level higher than that of the flow inlet 73 as shown in FIG. 10, the air trap container 72 is in the discharge state M2. The second air discharge control processor 104 controls the driving motor 94 to maintain the discharge state M2. In the discharge state M2, the air in the air trap container 72 is collected in the collection portion 88 in communication with the flow outlet 74. Therefore, in the discharge state M2, the air in the air trap container 72 is collected in the vicinity of the flow outlet 74.

Next, in step S103 in FIG. 12, after the control by the second air discharge control processor 104 is executed, the third air discharge control processor 105 controls the outlet valve 27 to be opened and controls the outlet pump 28 to be driven. At this point, as shown in FIG. 13, the outlet valve 27 is opened, and the outlet pump 28 is driven. Therefore, the air collected in the collection portion 88 of the air trap container 72 flows into the outlet flow channel 17 via the flow outlet 74 together with the ink in the air trap container 72 as represented by arrow A11, and is discharged into the exhaust liquid tank 29 as represented by arrow A12. At this point, the upstream pump 21 and the downstream pump 22 are in a pause state. Therefore, the air or the ink in the air trap container 72 does not flow into the upstream flow channel 15. In step S103, the ink and the air are discharged from the air trap container 72. Therefore, the air trap container 72, which is a pouch, is put into a crushed state. In this manner, the ink in the air trap container 72 is discharged outside in the discharge state M2.

When controller 55 controls as described above to put the air trap container 72 into the discharge state M2, the air in the air trap container 72 is easily discharged into the exhaust liquid tank 29. When the air trap container 72 is put into the discharge state M2, the air in the air trap container 72 is prevented from flowing into the upstream flow channel 15, the ink head 11, or the downstream flow channel 16.

In this preferred embodiment, as shown in FIG. 9, when the air trap container 72 is put into the collection state M1 by the inclination mechanism 75, the air trap container 72 is inclined such that the flow inlet 73 is at a level higher than that of the flow outlet 74. Therefore, the air contained in the ink flowing into the air trap container 72 through the flow inlet 73 is collected in the vicinity of the flow inlet 73. Thus, in the collection state M1, the air-containing ink does not easily flow outside through the flow outlet 74. As shown in FIG. 10, when the air trap container 72 is put into the discharge state M2 by the inclination mechanism 75, the air trap container 72 is inclined such that the flow outlet 74 is at a level higher than that of the flow inlet 73. Therefore, in the discharge state M2, the air in the air trap container 72 is collected in the vicinity of the flow outlet 74. Thus, in the discharge state M2, the air easily flows outside through the flow outlet 74. For this reason, the ink in the air trap container 72 that is supplied to the ink head 11 in the collection state M1 contains no air. In the discharge state M2, the ink in the air trap container 72 is not supplied to the ink head 11 but is discharged outside (in this example, the exhaust liquid tank 29). In this preferred embodiment, the inclination of the air trap container 72 is changed to easily change the collection state M1 to the discharge state M2 or to easily change the discharge state M2 to the collection state M1. Thus, the control is easily executed.

In this preferred embodiment, the air trap container 72 is provided of a flexible material. Therefore, when the ink and the air in the air trap container 72 are discharged in the discharge state M2, the air trap container 72 is put into a crushed state. Thus, air does not newly enter the air trap container 72 easily.

In this preferred embodiment, as shown in FIG. 10, the collection portion 88 is in communication with the flow outlet 74. When the air trap container 72 is in the discharge state M2, the air in the air trap container 72 is collected in the collection portion 88. Since the air is collected in the collection portion 88 in the discharge state M2, the air is easily discharged from the collection portion 88 toward the flow outlet 74.

In this preferred embodiment, as shown in FIG. 5, the air trap container 72 preferably is hexagonal as seen in a plan view, for example. The flow outlet 74 is provided in the side S4 of the hexagonal air trap container 72. It is now assumed that the sides of the air trap container 72 adjacent to the side S4 are the first side S2 and the second side S3. The first line L11 extending from the first side S2 and the second line L12 extending from the second side S3 define the angle R21 of 90 degrees. The collection portion 88 is provided between the first side S2 and the second side S3 adjacent to the side S4. Therefore, as seen in a plan view, the collection portion 88 has a width narrowing toward the flow outlet 74. For this reason, in the discharge state M2, the air in the air trap container 72 is easily collected in the vicinity of the flow outlet 74. Thus, the air is easily discharged through the flow outlet 74.

In this preferred embodiment, as shown in FIG. 6, the flow inlet 73 is provided in the side surface of the air trap container 72, at the center c1 in the thickness direction D11 of the air trap container 72. With such an arrangement, as shown in FIG. 9, in the collection state M1, the air in the air trap container 72 is collected in a portion of the air trap container 72 that is above the flow inlet 73. Thus, the air is prevented from flowing in the opposite direction through the flow inlet 73.

In this preferred embodiment, as shown in FIG. 7, the inclination mechanism 75 includes the rotation shaft 91 provided on the main body 71 and the driving motor 94 rotating the rotation shaft 91. With such an arrangement, the inclination state of the air trap container 72 is changed from the collection state M1 to the discharge state M2 or from the discharge state M2 to the collection state M1 by simply driving the driving motor 94 to rotate the rotation shaft 91.

In this preferred embodiment, the rotation shaft 91 preferably is located between the flow inlet 73 and the flow outlet 74 as seen in a plan view. With such an arrangement, the size of the range in which the main body 71 moves is decreased as compared with the case of an air trap unit in which a rotation shaft is located to the rear of a flow inlet or to the front of a flow outlet. This allows the air trap unit 25 to be installed in a small space.

At the time of printing, it is preferred that the ink in the ink flow channel 20 has a certain level of temperature (e.g., a predetermined temperature) or higher. Thus, in this preferred embodiment, as shown in FIG. 5, the heater 76 is provided below the air trap container 72. In more detail, in the case where, for example, the air trap container 72 is placed on the first carrying portion 81, the heater 76 is located between the air trap container 72 and the first carrying portion 81. The ink in the air trap container 72 is located below the air in the air trap container 72. In this preferred embodiment, a bottom surface of the air trap container 72 is warmed by the heater 76, and therefore, the ink in the air trap container 72 is easily warmed. Thus, the ink of a certain level of temperature is supplied to the ink flow channel 20.

In this preferred embodiment, as shown in FIG. 6, the flow inlet 73 is provided on a side surface of the air trap container 72, at the center c1 in the thickness direction D11 of the air trap container 72. Alternatively, the flow inlet 73 may be provided in a side surface of the air trap container 72, at a position below the center c1 in the thickness direction D11 of the air trap container 72.

The components of the controller 55, namely, the storage processor 101, the air collection control processor 102, the first air discharge control processor 103, the second air discharge control processor 104, and the third air discharge control processor 105 may be provided as software. Namely, the above-described components may be realized by the computer by a computer program being executed by the computer. The present invention encompasses a computer program for printing that causes a computer to act as the above-described components. The present invention encompasses a computer-readable storage medium having the computer program stored thereon. The above-described components may be processors realized by execution of the computer program stored on the controller 55. In this case, each of the components may be realized by one processor or a plurality of processors. The present invention encompasses a circuit realizing substantially the same functions as that of the program executed by the components.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiment described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An air trap, comprising:

an air trap container to store ink;

a flow inlet provided in the air trap container to allow the ink to flow into the air trap container;

a flow outlet provided in the air trap container to allow the ink in the air trap container to flow out; and an inclination mechanism to incline the air trap container such that the air trap container is put into one of a first state and a second state, the first state being a state where the air trap container is inclined such that the flow inlet is at a level higher than, or equal to, that of the flow outlet, and the second state being a state where the air trap container is inclined such that the flow outlet is at a level higher than that of the flow inlet.

2. The air trap unit according to claim 1, wherein the air trap container includes a flexible material.

3. The air trap unit according to claim 1, wherein the air trap container includes a collector in communication with the flow outlet to collect air contained in the ink in the air trap container when the air trap container is in the second state.

4. The air trap unit according to claim 3, wherein the collector includes a narrowing width portion that narrows toward the flow outlet as seen in a plan view.

5. The air trap unit according to claim 1, wherein the air trap container is hexagonal as seen in a plan view;

the flow outlet is provided in a side of the hexagonal air trap container as seen in the plan view; and the air trap container includes sides adjacent to the side in which the flow outlet is provided that include a first side and a second side, and a first line extending from the first side and a second line extending from the second side define an angle of 90 degrees.

6. The air trap unit according to claim 1, wherein the flow inlet is provided in a side surface of the air trap container, at a central position in a thickness direction of the air trap container or at a position below the central position.

7. The air trap unit according to claim 1, further comprising a main body on which the air trap container is to be placed; wherein the inclination mechanism includes:

a rotation shaft provided on the main body; and a driving motor to rotate the rotation shaft.

8. The air trap unit according to claim 7, wherein the rotation shaft is located between the flow inlet and the flow outlet as seen in a plan view.

9. The air trap unit according to claim 1, further comprising a heater provided below the air trap container.

10. An ink supply system, comprising:

an ink tank to store ink;

an ink head to eject the ink toward a recording medium;

an inlet flow channel including an end connected with the ink tank;

an upstream flow channel connected with the ink head to allow the ink to flow into the ink head;

a connection flow channel that connects the inlet flow channel and the upstream flow channel to each other;

an outlet flow channel including a first end connected with the connection flow channel and a second end connected with an exhaust liquid tank;

an upstream pump provided in the upstream flow channel to supply the ink to the ink head;

an upstream damper provided in the upstream flow channel at a position closer to the ink head than the upstream pump;

an outlet valve provided in the outlet flow channel and being openable and closable;

an outlet pump provided in the outlet flow channel at a position closer to the exhaust liquid tank than the outlet valve; and the air trap unit according to claim 1 provided in the connection flow channel.

11. The ink supply system according to claim 10, further comprising:

a downstream flow channel including a first end connected with the ink head and a second end connected with the connection flow channel;

a downstream pump provided in the downstream flow channel to allow the ink in the ink head to flow out; and a downstream damper provided in the downstream flow channel at a position closer to the ink head than the downstream pump is.

12. The ink supply system according to claim 11, further comprising a controller to control the upstream pump, the downstream pump, the outlet valve, the outlet pump and the inclination mechanism of the air trap unit; wherein the controller includes:

a first air discharge control processor to control the upstream pump and the downstream pump to stop;

a second air discharge control processor to control the inclination mechanism such that the air trap container is put into the second state, after the first air discharge control processor executes the control; and a third air discharge control processor to control the outlet valve to open and control the outlet pump to be driven, after the second air discharge control processor executes the control.

13. An inkjet printer, comprising:

the ink supply system according to claim 10; and a platen on which the recording medium is to be placed.

* * * * *